US005604718A

United States Patent [19]

Mignot et al.

[11] Patent Number: 5,604,718

[45] Date of Patent: Feb. 18, 1997

[54] TIMEPIECE COMPRISING AN ELECTRO-ACOUSTIC TRANSDUCER

[75] Inventors: Jean-Pierre Mignot, Peseux; Jacques Labourey, Neuchâtel; Michel Christen, Yverdon-Les-Bains, all of Switzerland

[73] Assignee: Asulab S.A., Bienne, Switzerland

[21] Appl. No.: 501,809

[22] Filed: Jul. 13, 1995

[30] Foreign Application Priority Data

Jul. 25, 1994 [CH] Switzerland ..... 02338/94

[51] Int. Cl.[6] ..... G04C 21/16

[52] U.S. Cl. ..... 368/255

[58] Field of Search ..... 368/255, 250, 368/72–74, 159; 316/334

[56] References Cited

U.S. PATENT DOCUMENTS

| | | | |
|---|---|---|---|
| 3,733,804 | 5/1973 | Diersbock . | |
| 3,869,855 | 3/1975 | Sodler | 368/243 |
| 4,023,162 | 5/1977 | Murakami | 340/384 |
| 4,271,498 | 6/1981 | Zafferri et al. . | |
| 4,321,699 | 3/1982 | Toyama et al. . | |
| 4,367,426 | 1/1983 | Kumada et al. . | |
| 4,392,747 | 7/1983 | Kumada et al. | 368/88 |
| 4,526,477 | 7/1985 | Murakami | 368/250 |

FOREIGN PATENT DOCUMENTS

| | | |
|---|---|---|
| 2154704 | 5/1973 | France . |
| 2408168 | 6/1979 | France . |
| 2072651 | 10/1981 | United Kingdom . |

*Primary Examiner*—Bernard Roskoski

[57] ABSTRACT

The piezo-electric device (9) which connects a glass (8) to a movement (3) of the timepiece (1) is arranged in such a way as to deform in flexion in response to an exciting signal applied to its electrodes. The attachment zones (9a,9b) of this device (9) to this glass (8) and respectively to this movement (3) are distinct one from the other when the timepiece (1) is looked at in a direction perpendicular to the planes of the principal faces of the device (9). Thanks to this arrangement, the sound produced by the displacement of the glass (8) when the exciting signal is applied to the electrodes of the piezo-electric device (9) is more intense than in a known timepiece.

10 Claims, 4 Drawing Sheets

TIMEPIECE COMPRISING AN ELECTRO-ACOUSTIC TRANSDUCER

FIELD OF THE INVENTION

The present invention relates to a timepiece comprising an electro-acoustic transducer, and more specifically a timepiece of which the glass forms the movable element of this transducer.

BACKGROUND OF THE INVENTION

Such a timepiece is described for example in the U.S. Pat. No. 4,271,498. It comprises in this case an annular member of a piezoelectric material having one face fixed to the movement and having the other face fixed to the heel of the glass.

When an alternating electric signal is applied to the electrodes arranged on the piezoelectric annular member, the thickness of the latter varies causing displacements of the glass and the production of an acoustic wave in the air surrounding the timepiece. The electro-acoustic transducer formed by the movement of the timepiece, by this annular member and by this glass functions thus as a loud-speaker.

When on the contrary an acoustic wave puts the glass under an alternating pressure, the displacements of this glass cause variations of the thickness of the piezoelectric annular member which provoke the appearance of an electric signal between the above-mentioned electrodes. In this case, the electro-acoustic transducer functions as a microphone.

In such a transducer, the amplitude of the displacements of the glass is clearly always identical to the variations of the thickness of the piezo-electric annular member.

As a result, when the transducer functions as a loudspeaker, the amplitude of the displacement of the glass is weak, so that the sound produced by these displacements will also be weak.

In a similar manner, when the transducer functions as a microphone, the amplitude of the electric signal produced in response to the displacements of the glass will also be weak.

SUMMARY OF THE INVENTION

An aim of the present invention is to propose a timepiece comprising an electro-acoustic transducer which does not present the inconveniences mentioned here-above, i.e. a transducer which, while it is being used as a loudspeaker, produces a clearly much stronger sound that the known transducer described here-above in response to an electric signal of the same amplitude and which, while it is being used as a microphone, provides an electric signal having a much larger amplitude than a known transducer in response to an identical displacement of the glass.

This aim is obtained by the timepiece having the features defined in the annexed claim 1.

BRIEF DESCRIPTION OF THE DRAWINGS

Other aims and advantages of the present invention will become more evident by the following description which is been made with reference to the annexed drawings in which.

DETAIL DESCRIPTION OF THE INVENTION

Figure 1:
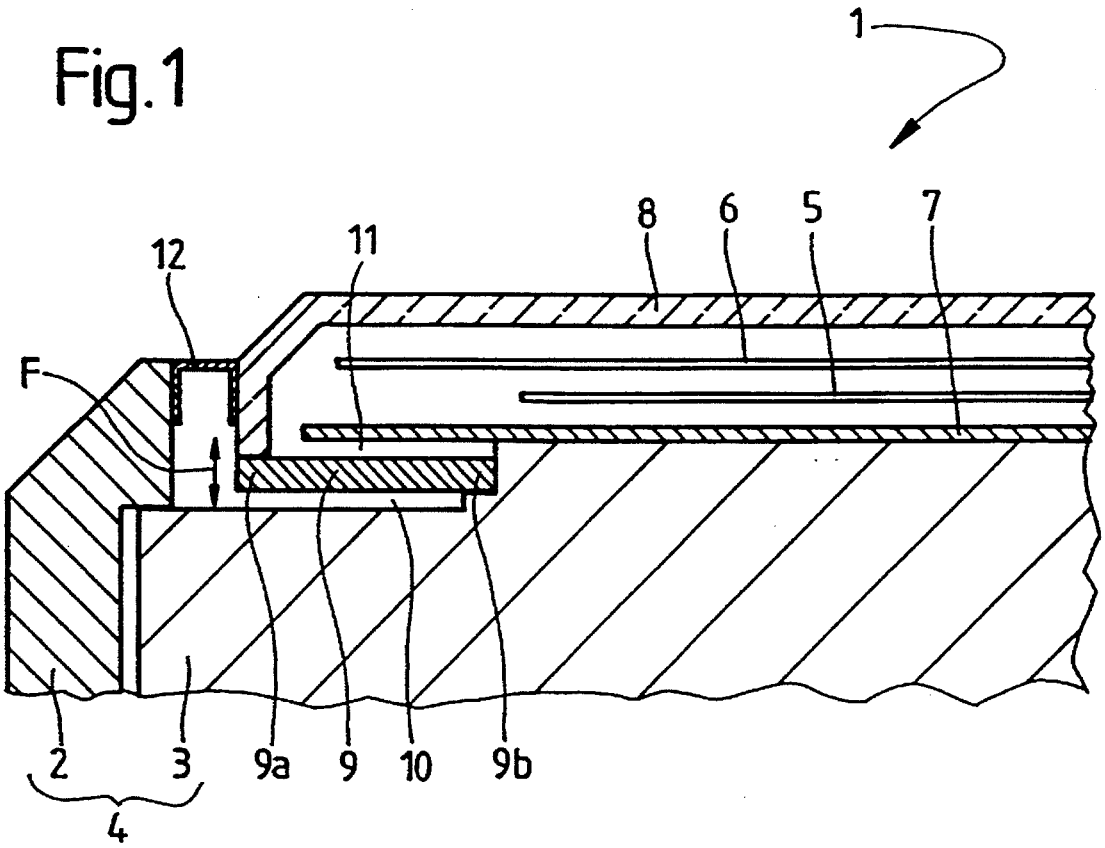
FIG. 1 represents by way of a non limitative example a first embodiment of the timepiece according to the present invention shown in a schematic sectional partial transversal view.

In the embodiment represented in a schematic and partial section in FIG. 1, the timepiece according to the present invention is designated by general reference 1.

Timepiece 1 comprises a case 2 of which only the casing body has been represented.

A movement 3 is fixed to the case 2 by attachment means which are not represented because they may be similar to any of numerous well known means which may be used to this effect.

For a reason which shall be rendered obvious further on, reference will be made to a mechanical set 4 which is representative of the one formed by case 2 and movement 3.

Timepiece 1 further comprises time information displaying means and possibly non time information displaying means which may be of any nature.

In the present example, these displaying means are simply constituted by an hour-hand 5 and by a minute-hand 6 which are both driven by movement 3 over dial 7 fixed to this latter.

Timepiece 1 further comprises a glass 8 arranged over hands 5 and 6 and dial 7 and intended, in a classical way, to protect these latter.

It will be admitted that in this embodiment of the timepiece according to the present invention, glass 8 is of the type generally named round glass, that is to say that in a plane view of the timepiece, glass 8 has the general form of a circle centered on the symmetric axis of this glass 8. As will be shown furtheron, glass 8 may also have a different form.

Glass 8 is fixed to movement 3 and thus to mechanical set 4 by the intermediate of a piezo-electric device 9 of which several examples will be shown furtheron.

It is simply mentioned here that the principal faces of device 9, i.e. those which are respectively situated on the side of glass 8 and on the side of the upper part of movement 3, are plane and perpendicular to the axis of rotation, not visible in FIG. 1, of hands 5 and 6. Furthermore, device 9 comprises a peripheral zone **9*a* fixed to glass 8 and an internal zone 9*b* fixed to movement 3. It should be noted that, when timepiece 1 is looked at in a direction perpendicular to the principal-faces of piezo-electric device 9, the attachment zones 9*a* and 9*b* of the latter to the glass 8 and to movement 3** are distinct one from the other.

For a reason which will be rendered obvious furtheron, movement 3 is arranged in such a manner that it leaves free spaces 10 and 11 between piezo-electric device 9 and, respectively the top face of movement 3 and the bottom face of dial 7.

The attachment means of glass 8 to the peripheral zone **9*a* of device 9 and of the internal zone 9*b* of the latter to the movement 3**, which are not represented, may be constituted by, for example, layers of an adhesive material such as a glue, a synthetic thermoplastic resin or the like.

Timepiece 1 preferably further comprises a waterproof gasket of the kind that is represented in FIG. 1 by reference 12, fixed to the circumference of glass 8 and to the body of case 2, for example by glueing. For a reason which will also be rendered obvious furtheron, this waterproof gasket is arranged, when it is present, in such a manner that glass 8 can be displaced easily relative to case 2.

As will also be described more in detail furtheron, device 9 comprises an element of a piezo-electric material which may be one of several piezo-electric materials well known to the specialist such as, for example, one of the ceramics which are lead- zirconium- and titanium based, generally called PZT. Device 9 further comprises electrodes and it is arranged in such a manner that, while these electrodes are subject to an exciting signal constituted by an alternating voltage produced by an adequate circuit situated for example in movement 3, it undergoes a flexion deformation in such a way that its peripheral zone 9*a* moves relative to internal zone 9*b* in a direction substantially perpendicular to the planes of the principal faces alternately in a forward and a backward motion along this direction. This direction and these forward and backward motions are symbolised in FIG. 1 by the double arrow F.

The displacement of peripheral zone 9*a* of device 9 will obviously cause an identical displacement of glass 8 relative to the mechanical set 4.

This displacement of glass 8 creates a acoustic wave in the air surrounding timepiece 1, and the fundamental frequency of the acoustic wave is obviously equal to that of the exciting signal applied to the electrodes of device 9. It will be understood that if this frequency is situated in a range of audible frequencies, i.e. approximately between 15 Hz and 15 kHz, the acoustic wave created by the displacement of glass 8 produces a sound perceptible by any person situated in the proximity of timepiece 1 and, in particular if timepiece 1 is a wrist-watch, by the wearer of this latter.

It is obvious that if the frequency and/or the amplitude of the exciting signal of piezo-electric device 9 are variable, the same applies to the fundamental frequency and respectively the amplitude of the acoustic wave created by the displacement of glass 8 and of the sound produced by the acoustic wave.

As can be seen, glass 8, piezo-electric device 9 and the mechanical set 4 form an electro-acoustic transducer which functions as a loudspeaker when an exciting signal is applied to the electrodes of device 9.

The skilled person may readily understand that if glass 8 moves relative to mechanical set 4 in response to an acoustic wave propagating trough the air surrounding timepiece 1, this displacement will provoke a flexion deformation of piezo-electric device 9 such that its peripheral zone 9*a* will move relative to its internal zone 9*b*, also in the direction substantially perpendicular to the planes of its principal faces as is symbolised by the double arrow F in FIG. 1.

This flexion deformation of piezo-electric device 9 provokes the appearance of a detection signal between its electrodes constituted by an alternating voltage having the same frequency as the acoustic wave which provokes the displacement of glass 8.

As can be seen, when an acoustic wave acts on glass 8, the electro-acoustic transducer formed by the latter, by the piezo-electric device 9 and by mechanical set 4, functions as a microphone.

Figure 2:
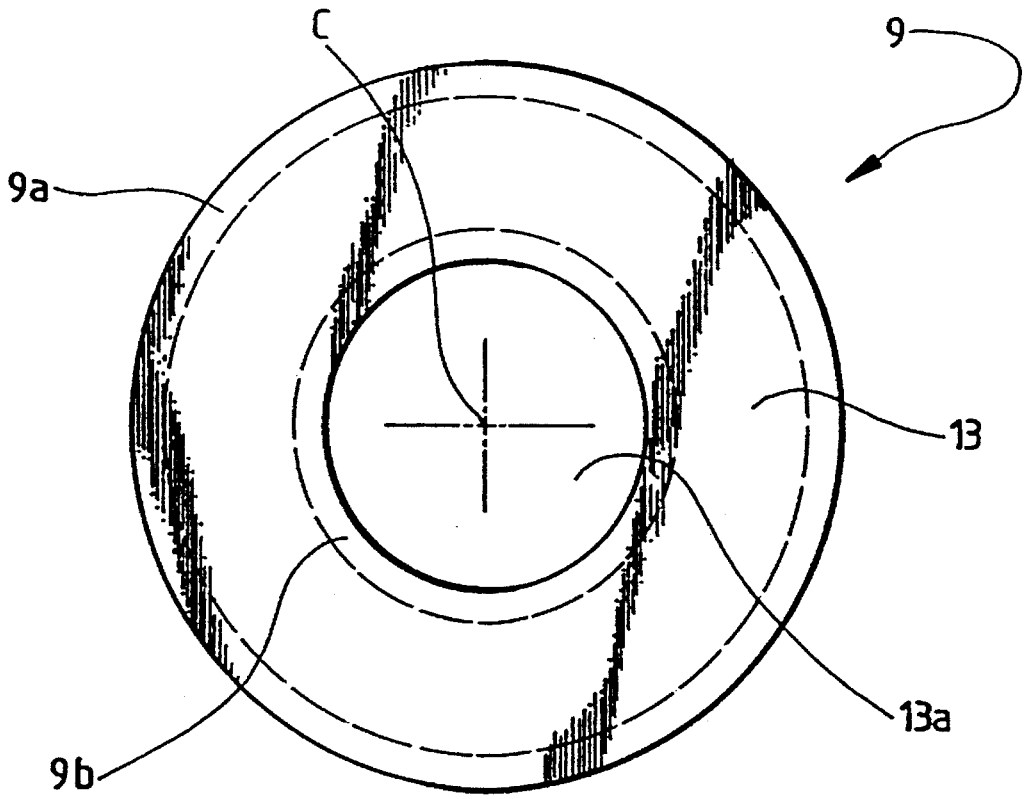
FIGS. 2 to 4 represent, also by way of a non-limitative example, piezo-electric devices usable in the timepiece according to the present invention shown in a plane view.

FIG. 2 represents schematically, in a different scale than the one of FIG. 1, an example of an embodiment of piezo-electric device 9 of FIG. 1 shown in a direction perpendicular to the planes of its principal faces.

In this example, device 9 comprises an element of a piezo-electric material 13 which has the general form of a thin circular disk having a centre C situated in the symmetrical axis of glass 8 and comprising a central opening 13*a* which is also circular and which is centred on point C.

The peripheral zone of element 13 constitutes the attachment zone 9*a* of piezo-electric device 9 to glass 8, and the zone surrounding opening 13*a* constitutes the attachment zone 9*b* of device 9 to movement 3.

The electrodes of the piezo-electric device 9 which have not been represented in FIG. 2 but of which examples will be described furtheron, are arranged in such a way so as to create an alternating electric field in the piezo-electric material of element 13 when the exciting signal mentioned hereabove is applied to them.

Further, element 13 and these electrodes are arranged in such a way that this electric field provokes a flexion deformation of device 9 so that it takes alternatively a concave or a convex form or, in other words, a splayed cross section form which is alternatively open at the side of glass 8 and at the side of movement 3.

The piezo-electric device 9 such as the one which has been described hereabove which reference to FIG. 2 may of course be used in a timepiece having a glass which is circular.

It is to be noted however, that such a piezo-electric device may also be used in a timepiece having a glass of a regular polygonal form, such a glass thus only been fixed to the device at several points of its circumference, these points being situated for example at the peaks and in the middle of the sides of this polygon.

Figure 3:
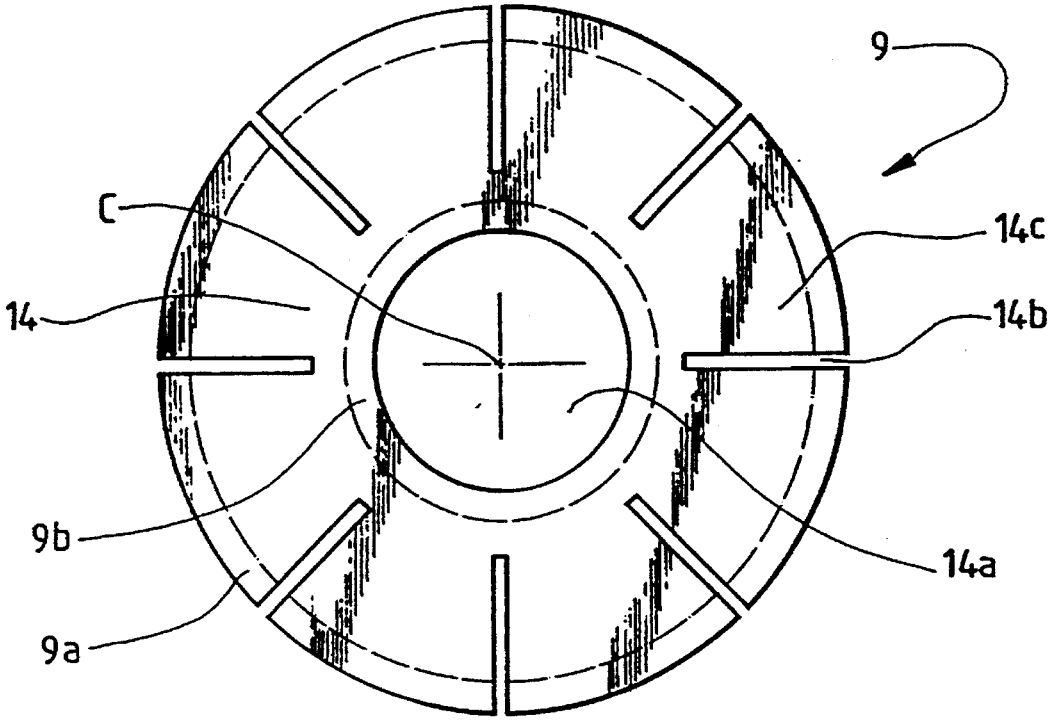

FIG. 3 represents schematically in a scale which is different from the one of FIG. 1, another example of an embodiment of piezo-electric device 9 of FIG. 1 shown in a direction perpendicular to the planes of its principal faces.

In this example, device 9 comprises an element of a piezo-electric material 14 which also has the general form of a thin circular disk of which the centre, also designated by C,is also situated on the symmetrical axis of glass 8, and which further also comprises a central circular opening 14*a*.

Element 14 further comprises radials slots 14*b* having in this example a constant width thereby defining in between these slots identical strips 14*c* which are connected one to the other by their base, that is by their extremity which is situated on the side of central opening 14*a*. The peripheral zone of strips 14*c* constitutes the attachment zone 9*a* of device 9 to glass 8, and the part of the base of these strips 14*c* which are situated around central opening 14*a* constitutes the attachment zone 9*b* of device 9 to movement 3.

The electrodes of piezo-electric device 9, which are also not represented in FIG. 3, are arranged in such a way that when they are subject to an exciting signal, all strips 14*c* will undergo a flexion deformation giving device 9 of this FIG. 3 a form which is similar to the one described relative to disc 13 in figure 2.

Figure 4:
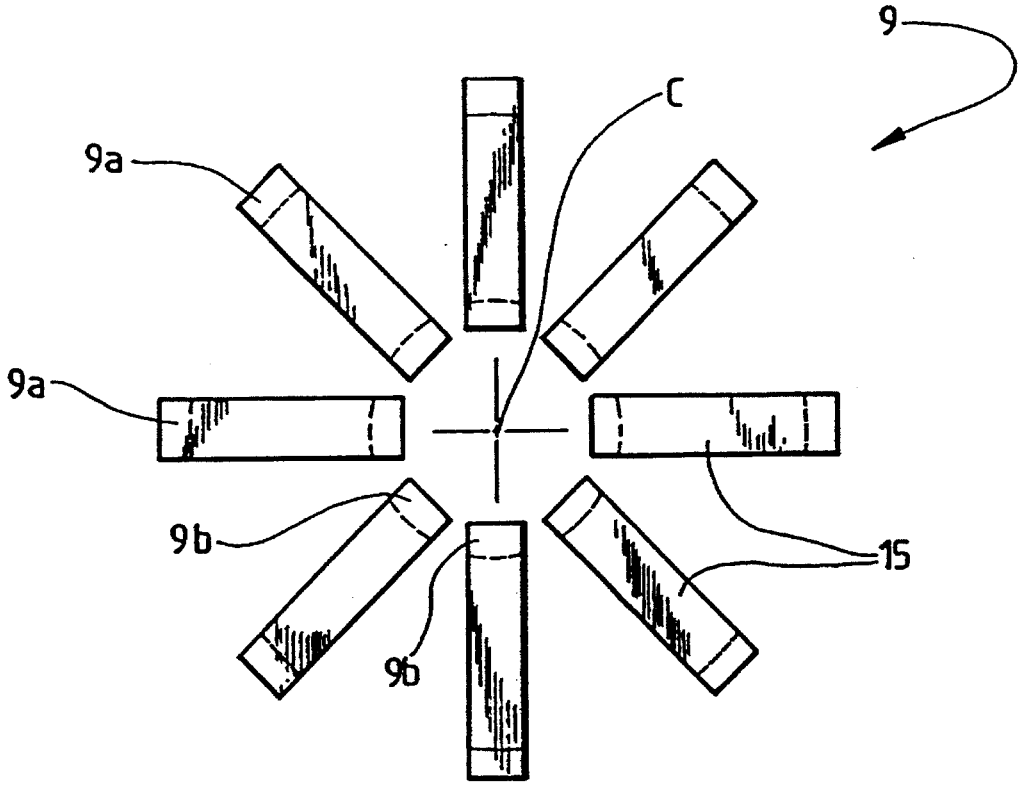

FIG. 4 represents schematically, in a scale which is different from the one of FIG. 1, another example of an embodiment of piezo-electric device 9 of this FIG. 1, shown in a direction perpendicular to the planes of its principal faces.

In this example, device 9 comprises an element of piezo-electric material which is constituted by a plurality of thin strips 15.

Strips 15 which are represented schematically in FIG. 4 in the position they occupy in timepiece 1, each have the general form of a parallelepiped rectangular, and their main faces, that is those which are parallel to the plane of FIG. 4, constitute together the main faces of device 9.

Strips 15 are arranged in this example in such a way that their longitudinal axes all pass through a central point which is also situated on the symmetrical axis of glass 8 and designated by C.

All strips 15 are fixed to glass 8 at their external zones, that is those zones which are furthest away of central point C, all the zones together constituting the attachment zone 9*a* of piezo-electric device 9 to glass 8. Strips 15 are further fixed to movement 3 by their internal zones, that is those zones which are closest to central point C, these zones-thus constituting together attachment zone 9*b* of piezo-electric device 9 to movement 3.

The electrodes of piezo-electric device 9, which are also not shown in FIG. 4, are arranged on strips 15 in such a way that when they are subject to an exciting signal, all of these strips 15 will undergo a flexion deformation in the direction perpendicular to their main faces, alternatively in a forward and a backward motion along this direction.

Piezo-electric device 9 of the timepiece according to the present invention may of course also be obtained in several different ways than the ones described referring to FIGS. 2 to 4.

Thus, in embodiments similar to the one illustrated in FIG. 3, the element of piezo-electric material of device 9 may comprise a number of strips such as strips 14*c*, this number of strips being different from the latter, i.e. from eight.

Moreover, and no matter what the number of these strips, their form may be different from the form shown in FIG. 3.

Thus for example, these strips may have a form which is such that the slots separating them, like slots 14*b*, have a width which increases or which decreases in the direction of their open extremities.

Also, still as way of an example, the exterior extremity of these strips maybe rectilinear, and not in circular arcs such as in FIG. 3. In such a case, the element of piezo-electric material of device 9 has the general form of a regular polygon of which the number of sides is equal to the number of strips of this element, and this device 9 is intended to be used preferably in a timepiece having a glass which has a corresponding polygonal form.

Still in embodiments similar to the one illustrated in FIG. 3, the strips of the element of piezo-electric material of device 9 will be connected one to the other at their external extremities, that is those which are opposed to the central opening such as opening 14*a*, the slots separating these strips being in such a case open at the side of this central opening.

In embodiments similar to the one illustrated in FIG. 4, the element of piezo-electric material of device 9 may also comprise a number of strips, similar to strips 15, this number being different from the latter, that is from eight, and the form of these strips being different from the parallelepiped form of these strips 15.

It is to be noted that, an element of piezo-electric material formed of independent strips such as strips 15 the element represented in FIG. 4 may be used in a timepiece according to the present invention no matter what the form, round, oval, polygonal or other, of glass 8. For this, it suffices that these strips are arranged in such a way that their extremities are attached to glass 8 and that their other extremities are attached to movement 3. As will be readily seen, it is not even necessary that the longitudinal axes of these plates all pass trough the same point.

Also, the only condition to be fulfilled by these strips is that their extremities which are attached to glass 8 will all be displaced in substantially the same quantity and in the same sense of direction in response to an exciting signal applied to the electrodes of piezoelectric device 9. It will also be readily seen that this condition may be fulfilled even if these strips do not all have the same dimensions, for example because of the place available in the casing of the timepiece according to the invention.

Whatever its general form, piezo-electric device 9 of a timepiece according to the present invention may be obtained in several ways of which two will be described hereafter referring to respectively FIG. 5 and FIG. 6 by arbitrary using for example device 9 as represented in FIG. 2.

Figure 5:
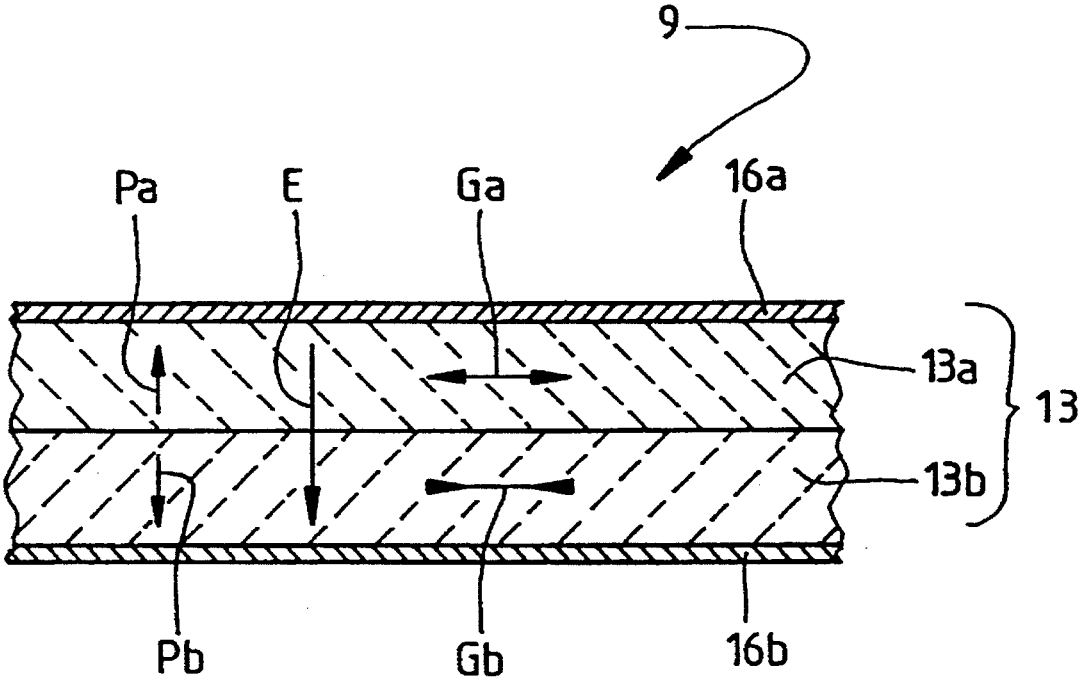
FIGS. 5 and 6 are schematic partial sections illustrating also by way of a non-limitative example, ways of obtaining the piezo-electric devices such as those of FIGS. 2 to 4.

In the case of FIG. 5, which is a partial and schematic cross section according to any radius of the device 9 in FIG. 2, the element of piezo-electric material 13 of the latter comprises two plates designated by 13*a* and 13*b*, which both have a general form identical to the form of element 13 and which are attached one to the other for example by a layer of an adhesive material, non represented, such as a glue, an epoxyde resin or the like.

Plates 13*a* and 13*b* are both of a piezo-electric material, which may be any of several piezo-electric materials well known to the piezo-electric specialists, such as the PZT mentioned hereabove. Whatever its nature, this piezo-electric material is polarised in a direction perpendicular to the faces of plates 13*a* and 13*b* and thus to the principal faces of device 9.

In this example, the direction of polarisation of the material of plate 13*a*, which is symbolised by the arrow Pa, is opposed to the direction of polarisation of the material of plate 13*b*, which is symbolised by the arrow Pb.

The electrodes of device 9, designated by references 16*a* and 16*b*, are arranged on the outer faces of the element 13 by any of several well known methods for doing so. When these electrodes 16*a* and 16*b* are subject to an alternating voltage constituting the exciting signal mentioned hereabove, the electric field created by this voltage thus also has a direction perpendicular to the outer faces of element 13.

This electric field is symbolised in FIG. 5 by arrow E in the situation in which its direction is opposed to the one of the polarisation Pa of plate 13*a* and identical to the one of polarisation Pb of plate 13*b*.

The skilled person will readily understand that, in this situation, plate 13*a* will dilate in the radial direction parallel to the plane of its faces, as is symbolised by the arrow with two divergent tips Ga, and that plate 13*b* will contract also in the radial direction parallel to the plane of its faces, which is symbolised by the arrow having two convergent points Gb. Element 13 thus deforms flexibly in a direction substantially perpendicular to the planes of its faces, its face comprising electrode 16*a* becoming convex and its face comprising electrode 16*b* becoming concave.

The skilled person will readily understand that in the inverse situation, i.e. the situation in which the direction of electric field E is identical to the polarisation Pa of plate 13*a* and opposed to the direction of polarisation Pb of plate 13*b*, element 13 also flexionally deforms in the same way but in the opposed direction to the former, its face comprising electrode 16a thus becoming concave and its face comprising electrode 16*b* becoming convex.

The internal zone 9*b* of piezo-electric device 9 being attached to movement 3 as was described here before referring to FIG. 1, peripheral zone 9*a* will thus move in a direction substantially perpendicular to the plane of the faces of device 9 symbolised by the arrow F in this FIG. 1.

Figure 6:
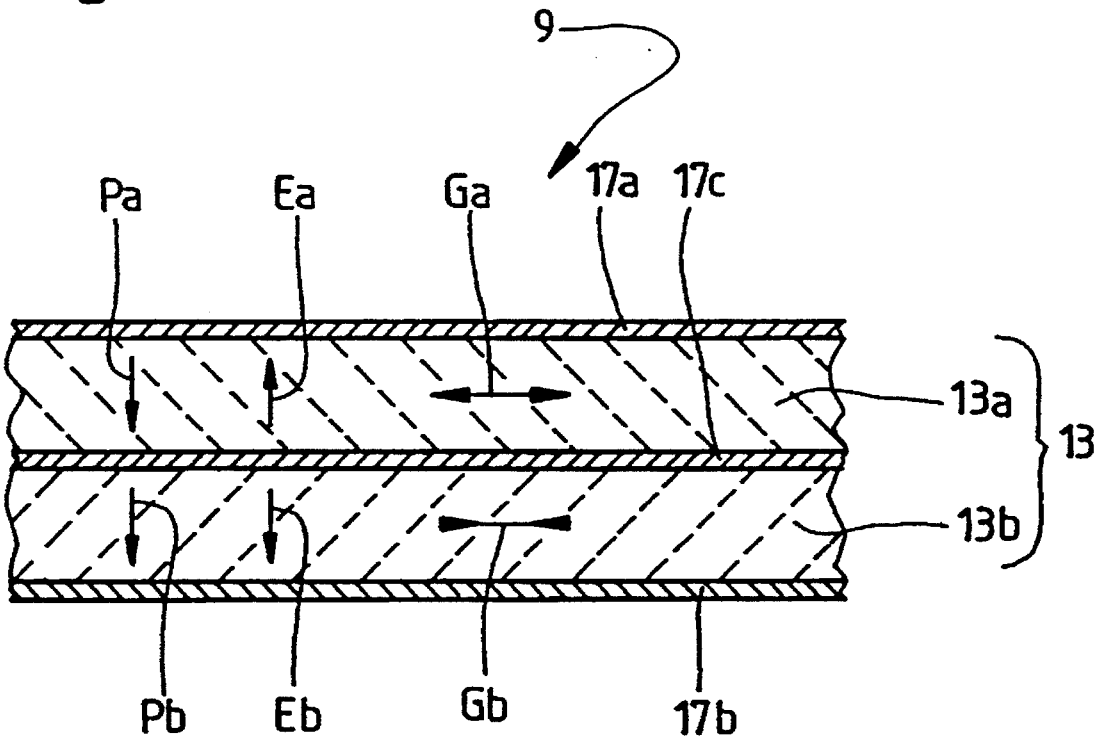

In the case of FIG. 6, which is also a partial schematical cross section along any radius of device 9 of FIG. 2, the element of piezo-electric material 13 of the latter also comprises two plates which are also designated by references 13*a* and 13*b* and which will not be described here, because they are identical to the plates designated by the same references in FIG. 5.

It is however to be noted that, in the case of this FIG. 6, plates 13*a* and 13*b* are arranged in such a manner that their respective directions of-polarity, also designated by Pa and Pb, are the same.

Device 9 comprises in this case two electrodes 17*a* and 17*b* arranged on the external faces of plates 13*a* and 13*b* and a third electrode 17*c* arranged between these plates 13*a* and 13*b* which are fixed one to the other by way of this intermediary.

This electrode 17*c* may be for example arranged on a face of plate 13*a* which is intended to be positioned facing plate 13*b* and to be attached to the latter by a film of an adhesive material which has not been represented. This electrode 17*c* may also be constituted by a metallic thin film on the respective faces of which, plates 13*a* and 13*b* are deposited by way of the well-known technique of thin film deposition.

Electrodes 17*a* and 17*b* are electrically connected one to the other in a manner which has not being represented, in such a way that they form, functionnaly, one single electrode which will be called electrode 17*ab*. As a result, when the alternating voltage constituting the exciting signal mentioned hereabove is applied to this electrode 17*ab* and to the electrode 17*c*, the electric field created by this voltage comprises two components Ea and Eb, respectively acting on plate 13*a* and on plate 13*b*, these two components Ea and Eb both being perpendicular to the faces of these plates 13*a* and 13*b*, but having opposite directions.

The skilled person will readily see that, like the piezo-electric device 9 in FIG. 5, the one of FIG. 6 flexionally deforms alternatively in the directions perpendicular to the planes of its principal faces while an exciting signal is applied to its electrodes 17*ab* and 17*c*.

Figure 7:
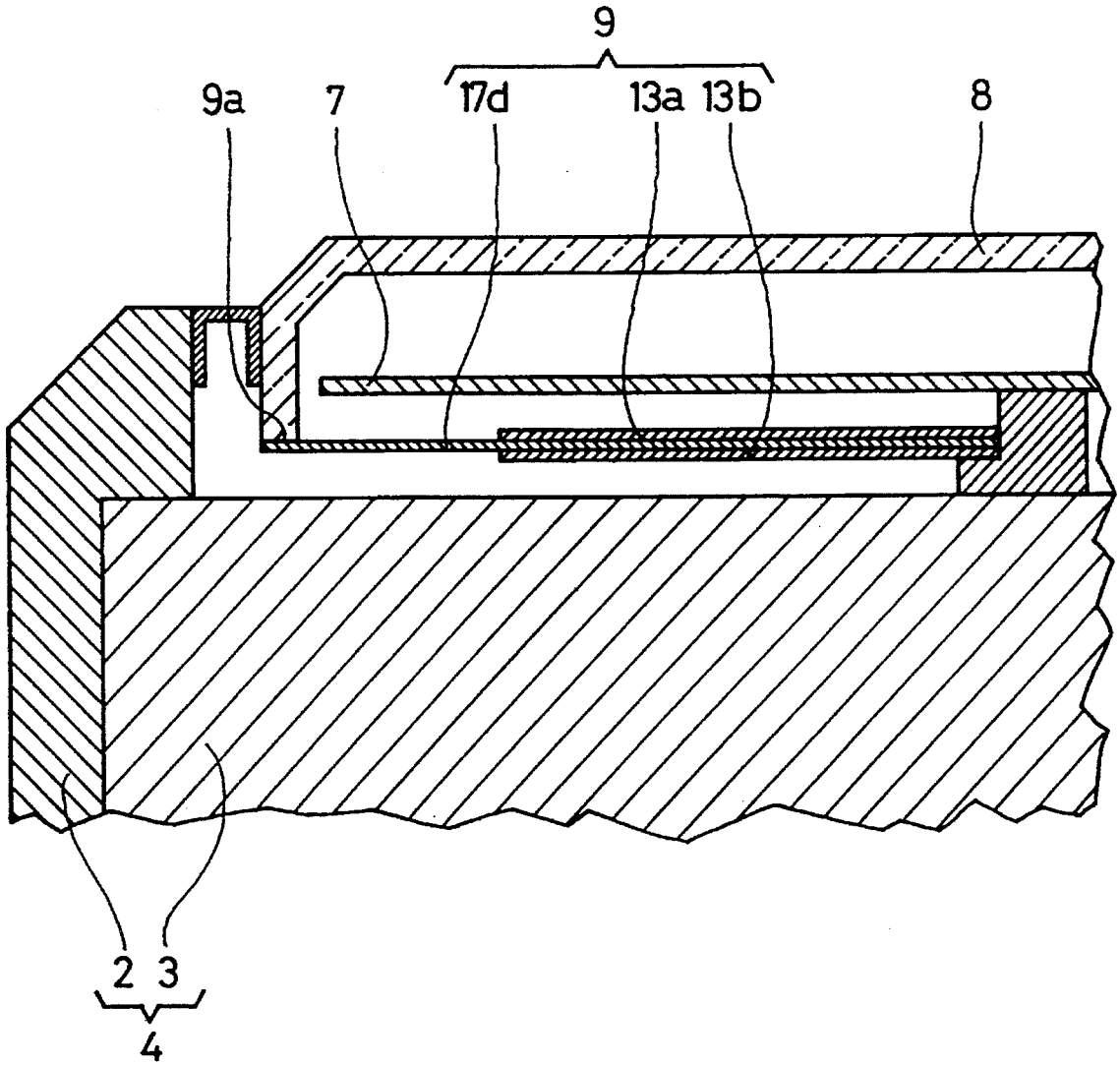
FIG. 7 represents also by way of a non limitative example, a second embodiment of the timepiece according to the present invention shown in a schematic sectional transversal partial view.

In the case of FIG. 7, which represents the second embodiment of the timepiece according to the present invention shown in a transversal portional schematical cross section, the third electrode 17*c* represented in FIG. 6 has been replaced by a metal sheet 17*d* arranged between piezo-electric plates 13*a* and 13*b* and thus forming together the piezo-electric device 9. The references in this FIG. 7 correspond to the references of FIG. 1.

Advantageously, metal sheet 17*d* extends along the continuation of its plane towards the exterior in such a way that this sheet 17*d* surpasses, on the exterior side relative to timepiece 1, the extremities of plates 13*a*, 13*b*. In this way, it is the extremity 9*a* of sheet 17*d* which acts as the support and as the attachment point of glass 8 of timepiece 1.

Thanks to this metal sheet 17*d*, the frequency response of piezo-electric device 9 may be modified by choosing an appropriate thickness, length and rigidness of this metal sheet 17*d*. As such, the bandwidth of piezo-electric device 9 may be adapted to its needs. Sheet 17*d* may be made of for example Copper-Beryllium (CuBe). In this example, metal sheet 17*d* has a thickness of about 100 μm ($100.10^{-6}$ m), and a diameter of about 41 mm ($41.10^{-3}$ m). Furthermore, the earthing of piezo-electric device 9 comprising a metal sheet 17*d* has being made easier relative to the device 9 described with reference to FIGS. 1 and 6, because the entire length of the sheet 17*d* is available to this effect. Moreover, the piezo-electric device is thus made less fragile.

It should be noted that the electrodes described hereabove by way of example may cover the entire faces of the plates on which they are arranged, or only a part of these faces, in particular the part situated between the attachment zones of the piezo-electric device to the glass and to the mechanical set defined hereabove.

Many modifications may be applied to the timepiece which has been described herebefore without departing from the scope of the present invention.

Among these modifications, which can not all be described, one that is mentioned is the one which consists of arranging piezo-electric device 9 at least substantially in the same plane as dial 7 and around this dial.

Another modification which should be mentioned here, is the one which consists of attaching piezo-electric device 9 to dial 7, thereby making sure to leave a free space between this device 9 and this dial 7, similar to the space 10 of FIG. 1. In such a case, it will be admitted that the mechanical set 4 defined hereabove will comprise dial 7 too.

Another modification which should be mentioned here consists of arranging piezo-electric device 9 in such a way that it is situated around glass 8 and attached either to the circumference of movement 3 or to the internal wall of the body of case 2.

In such a case, the attachment zones of device 9 to glass 8 and to the mechanical set 4 are naturally the internal zone and, respectively, the external zone of this device 9.

Summarising, as can be seen, in a timepiece according to the present invention, the piezo-electric device, which is connected to the glass and to the mechanical set formed by the case, the movement and, as the case may be, the dial, is arranged in such a way as to flexionally deform in a direction perpendicular to the planes of its faces in response to an exciting signal applied to its electrodes, with its attachment zones attached to the glass and to the mechanical set being distinct one from the other when the timepiece is looked at in this same direction.

The skilled person will readily understand that, thanks to this arrangement, the displacement amplitude of the glass in response to the exciting signal given, and thus the intensity of the sound produced, is much greater, with all the other parameters being equal, in a timepiece according to the present invention than in a known timepiece such as has been briefly described hereabove.

Also, still thanks to this arrangement, the displacement amplitude of the glass in response to a given acoustic wave, and thus the amplitude of the detection signal appearing between the electrodes of the piezo-electric device, it is much greater than, with all the other parameters being equal, in a timepiece according to the present invention then in a known timepiece.

What is claimed is:

1. A timepiece comprising a casing, a movement arranged in said casing and forming with the latter a mechanical set, a glass, and means for joining said glass to said mechanical set comprising a piezo-electric device having a first attachment zone fixed to said glass and a second attachment zone fixed to said mechanical set, said piezo-electric device having a first face situated in a plane and being arranged such that it undergoes, in response to an exciting signal, a deformation producing a displacement of said glass relative to said mechanical set in a direction at least substantially perpendicular to said plane, wherein said first attachment zone and said second attachment zone are distinct one from the other when said timepiece is looked at in a direction perpendicular to said plane, and wherein said deformation of said piezoelectric device is a flexion deformation in a direction perpendicular to said plane.

2. The timepiece according to claim 1, wherein said piezo-electric device comprises, on the one hand, two plates of a polarized piezo-electric material, the two polarizations of the piezo-electric material of said plates both being perpendicular to said plane, and said plates each being delimited by two flat faces parallel to said plane and being attached one to the other so that a first face of each of said plates is arranged facing a first face of the other of said plates and, on the other hand, electrodes arranged such that they create in said plates and in response to an exciting signal, an electric field perpendicular to said plane, said electric field being in the same direction as the direction of one of said polarizations and being in the opposite direction of that of the other of said polarizations.

3. The timepiece according to claim 2, wherein said polarizations have opposite directions, and wherein said electrodes are arranged such that said electric field has the same direction in both of the two plates.

4. The timepiece according to claim 2, wherein said polarizations have the same direction and wherein said electrodes are arranged such that said electric field has a first component in one of said plates and a second component in the other of said plates the directions in which these components are facing being opposed to one another.

5. The timepiece according to claim 1, wherein said device comprises an element of a piezo-electric material having the general form of a circular disk having a central zone in which is situated one of said attachment zones and a peripheral zone in which is situated the other of said attachment zones.

6. The timepiece according to claim 5, wherein said element comprises a central circular opening, a zone of said element which is situated around said opening constituting said central zone.

7. The timepiece according to claim 1, wherein said piezo-electric device comprises an element of a piezo-electric material comprising a plurality of strips connected one to the other by one of their extremities, a central zone of said element constituting one of said attachment zones and a peripheral zone of said element constituting the other of said attachment zones.

8. The timepiece according to claim 7, wherein said element comprises a central opening, the zone of said element which is situated around said opening constituting said central zone.

9. The timepiece according to claim 1, wherein said device comprises a plurality of strips of a piezo-electric material each having a first and a second extremity, said first extremities constituting together one of said attachment zones and said second extremities constituting together the other of said attachment zones.

10. The timepiece according to claim 4, wherein said piezo-electric device further comprises a metal sheet arranged between said piezo-electric plates in such a way that the exterior extremity of said metal sheet surpasses the exterior extremities of said piezo-electric plates thus forming said first attachment zone.

* * * * *